United States Patent [19]

Kasai et al.

[11] Patent Number: 5,067,159

[45] Date of Patent: Nov. 19, 1991

[54] STRUCTURE OF A SPEAKER APPARATUS

[75] Inventors: Junichi Kasai; Wataru Yagihashi, both of Kanagawa; Akira Yatsunami, Saitama; Kazuyuki Kurano, Saitama, all of Japan

[73] Assignees: Nissan Motor Company, Limited, Yokohama; Clarion Company, Limited, Tokyo, both of Japan

[21] Appl. No.: 218,261

[22] Filed: Jul. 13, 1988

[30] Foreign Application Priority Data

Jul. 14, 1987 [JP] Japan ..... 62-175327

[51] Int. Cl.[5] ..... H04R 1/02

[52] U.S. Cl. ..... 381/90; 381/158; 381/188; 381/205; 181/144; 181/146

[58] Field of Search ..... 381/188, 205, 86–87, 381/90, 88, 24, 152, 153, 158, 155, 156, 160, 184, 186; 181/144, 146, 141, 150, 152, 159, 160

[56] References Cited

U.S. PATENT DOCUMENTS

| | | | |
|---|---|---|---|
| 4,178,473 | 12/1979 | Vermeren | 381/86 |
| 4,357,490 | 11/1982 | Dickey | 381/90 |
| 4,493,389 | 1/1985 | Del Rosario | 181/141 |
| 4,612,530 | 9/1986 | Kurth et al. | 381/86 |
| 4,625,829 | 12/1986 | Sirois | 181/141 |
| 4,701,951 | 10/1987 | Kash | 381/24 |
| 4,703,502 | 10/1987 | Kasai et al. | 381/86 |
| 4,720,867 | 1/1988 | Imai et al. | 381/86 |
| 4,790,408 | 12/1988 | Adair | 381/156 |

FOREIGN PATENT DOCUMENTS

| | | | |
|---|---|---|---|
| 3407300 | 9/1985 | Fed. Rep. of Germany | 181/150 |
| 3503697 | 8/1986 | Fed. Rep. of Germany | 381/188 |
| 55-165570 | 11/1980 | Japan . | |
| 57-17299 | 1/1982 | Japan | 381/86 |
| 57-164695 | 10/1982 | Japan | 381/156 |
| 60-199296 | 10/1985 | Japan | 381/153 |
| 61-264896 | 11/1986 | Japan | 381/155 |

OTHER PUBLICATIONS

WO8501176 Loudspeaker Structure, Wolcott.

*Primary Examiner*—Forester W. Isen
*Attorney, Agent, or Firm*—Foley & Lardner

[57] ABSTRACT

A speaker apparatus in which a speaker unit having a vibrating plate thereon is housed in a cabinet, an opening defined by the cabinet for radiating a sound generated at a front surface of the vibrating plate of the speaker unit is formed, and a shield plate over a predetermined part of the opening is provided for shielding the sound of a high frequency region in which peaks and/or dips are included due to the sound reflections in the cabinet.

17 Claims, 5 Drawing Sheets

STRUCTURE OF A SPEAKER APPARATUS

BACKGROUND OF THE INVENTION

1. Field of the Invention

The present invention relates to a structure of a speaker apparatus applicable to a vehicle which improves the audible frequency characteristic of the speaker apparatus.

2. Background of the Art

Japanese Utility Model Application First Publication (non-examined) Sho 55-165570 exemplifies a speaker structure.

The structure of the speaker apparatus disclosed in the above-identified Japanese Utility Model Application Publication includes an opening defined by a side surface of a lower casing and a speaker unit incorporated into the lower casing so as to face upward. In addition, an upper casing covers the speaker unit and lower casing. The upper casing is in a non-bottom shape and has another opening at a side surface opposite to the opening of the lower casing.

Thus, a cabinet of the speaker is constituted by the lower casing and upper casing with a ceiling of the lower casing as an intermediate partitioning wall.

In the structure of the speaker described above, a ceiling of the upper casing opposes a front surface of a vibrating plate of the speaker unit. An interval distance between the ceiling of the upper casing and vibrating plate is normally set about to 3 cm.

Therefore, a sound radiated toward a front surface of the vibrating plate repeats its reflection so that a resonance occurs having a frequency f expressed in the following equation.

$f = C \times n/2\,l$ (C denotes sound speed, l denotes an interval of distance between the vibrating plate and ceiling, and n = 1,2,3, - - - ).

Hence, the sound radiated from the opening of the upper casing is caused to generate a peak and dip at a frequency above about 7.5 KHz and generate a acoustical distortion even in a band about half of the frequency. Consequently, a flat frequency characteristic, an ideal frequency characteristic provided by the speaker apparatus cannot be achieved.

SUMMARY OF THE INVENTION

It is therefore an object of the present invention to provide a structure of a speaker apparatus which improves the frequency characteristic of the speaker apparatus and prevents generator of a peak or dip in a frequency band.

The above-described object can be achieved by providing a structure of a speaker apparatus, comprising: (a) a speaker unit having a vibrating plate thereon; (b) an opening defined by a cabinet in which the speaker unit is incorporated, so that a sound at a front surface of the vibrating plate is radiated in a direction different from a vibration direction of the vibrating plate; and (c) means for shielding a sound distorted due to its reflections within the cabinet.

The above-described object can also be achieved by providing a structure of a speaker applicable to an automotive vehicle, comprising: (a) a speaker unit having a vibrating plate thereon; (b) a first opening defined by a cabinet in which the speaker unit is incorporated, so that a sound at a front surface of the vibrating plate is radiated in a direction different from a vibrating direction of the vibrating plate, the cabinet being located on a center of an instrument panel of the vehicle and (c) means for shielding a sound distorted due to its reflections within the cabinet.

The above-described object can also be achieved by providing a structure of a speaker apparatus, comprising: (a) a sound producing object; (b) a container housing the sound producing object and having an opening in a direction substantially perpendicular to a direction toward which the sound is propagated from the sound producing object; and (c) means provided at the opening so as to provide a substantially flat frequency characteristic for the sound generated by the sound producing object and heard by a listener.

DETAILED DESCRIPTION OF THE PREFERRED EMBODIMENTS

Reference will hereinafter be made to the drawings in order to facilitate understanding of the present invention.

Before explaining preferred embodiments of the present invention, an overall audio system applicable to an automotive vehicle will be described with reference to FIG. 8.

Figure 8:
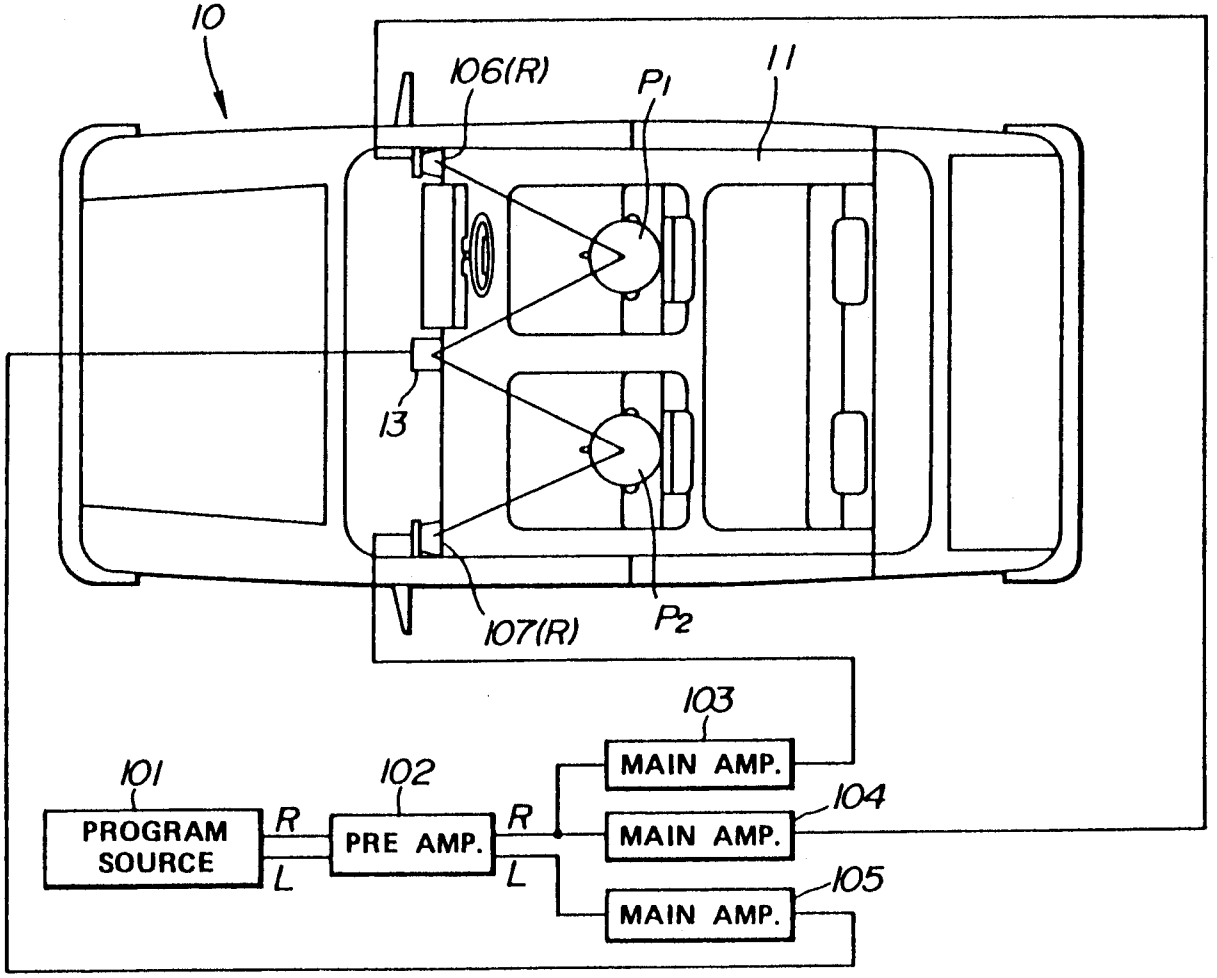
FIG. 8 is a generally conceptual view for explaining each preferred embodiment shown in FIGS. 1 to 7.

As shown in FIG. 8, a program source 101 constituted by a tuner, deck, CD (Compact Disc) player having a right (R) and left (L) channels each connected to a pre-amplifier 102 and main amplifiers 103, 104, and 105.

The R channel main amplifiers 103, 104 are connected to side speakers 106(R), 107(R). The side speakers 106(R), 107(R) are mounted on both sides of an instrument panel 12 installed within a passenger compartment 11 of the automotive vehicle generally denoted by 10.

On the other hand, a speaker apparatus denoted by 13 is connected to the L channel main amplifier 105. The speaker apparatus 13 is mounted on an upper surface of a center part of the instrument panel 12.

Figure 1:
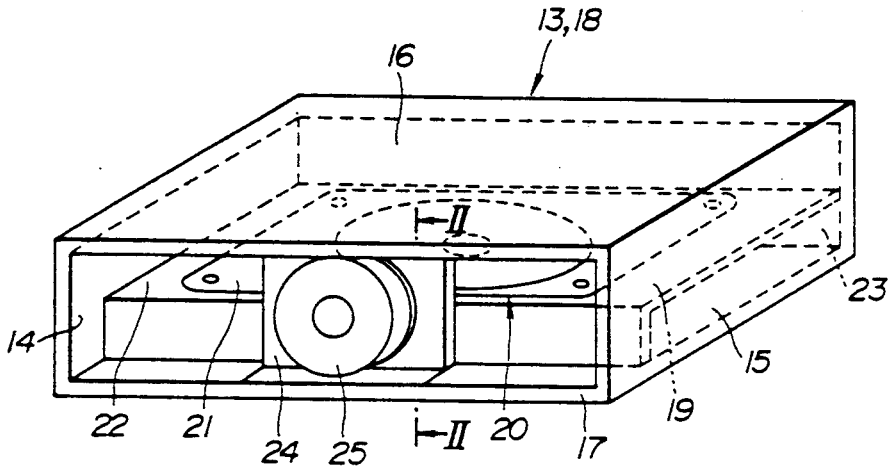
FIG. 1 is a perspective view of a structure of a speaker in a first preferred embodiment according to the present invention.
Figure 2:
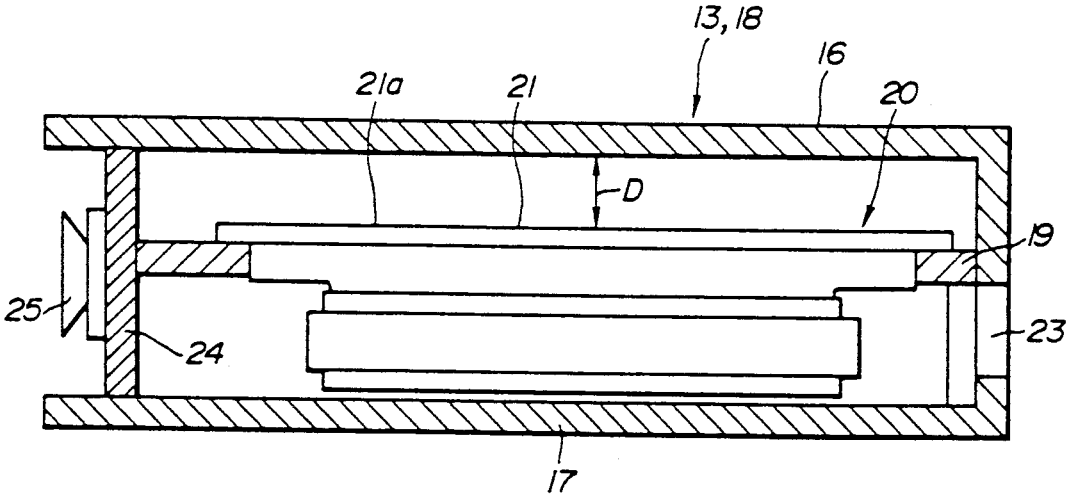
FIG. 2 is a cross sectional view of the structure of the speaker cut away along a line II—II of FIG. 1.
Figure 3:
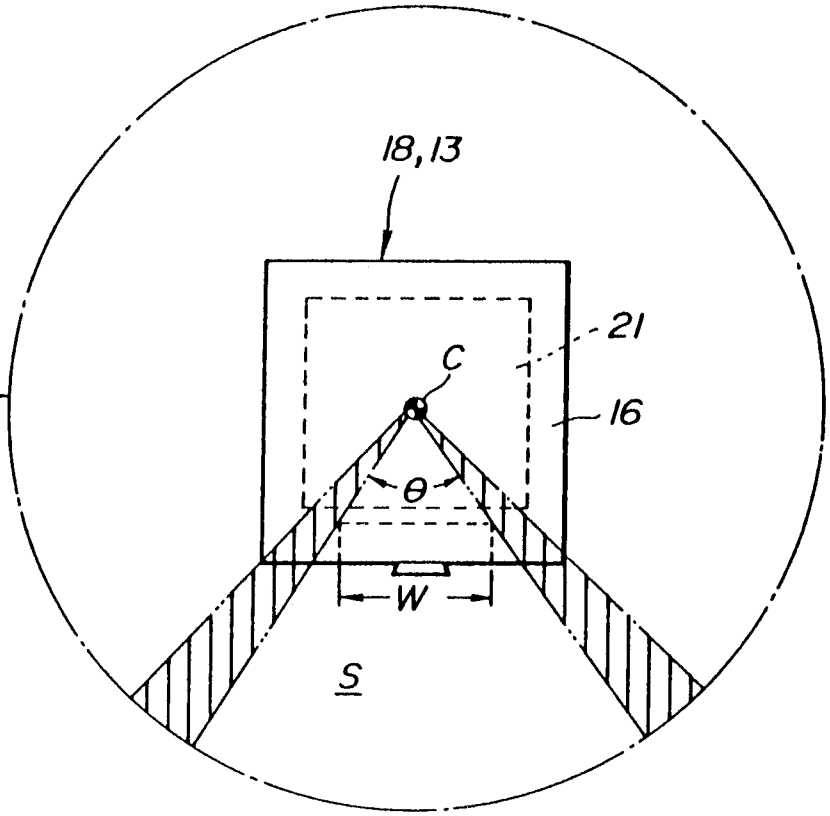
FIGS. 3(A) and 3(B) are explanatory views for explaining an operation of the structure of the speaker shown in FIGS. 1 and 2.
Figure 3:
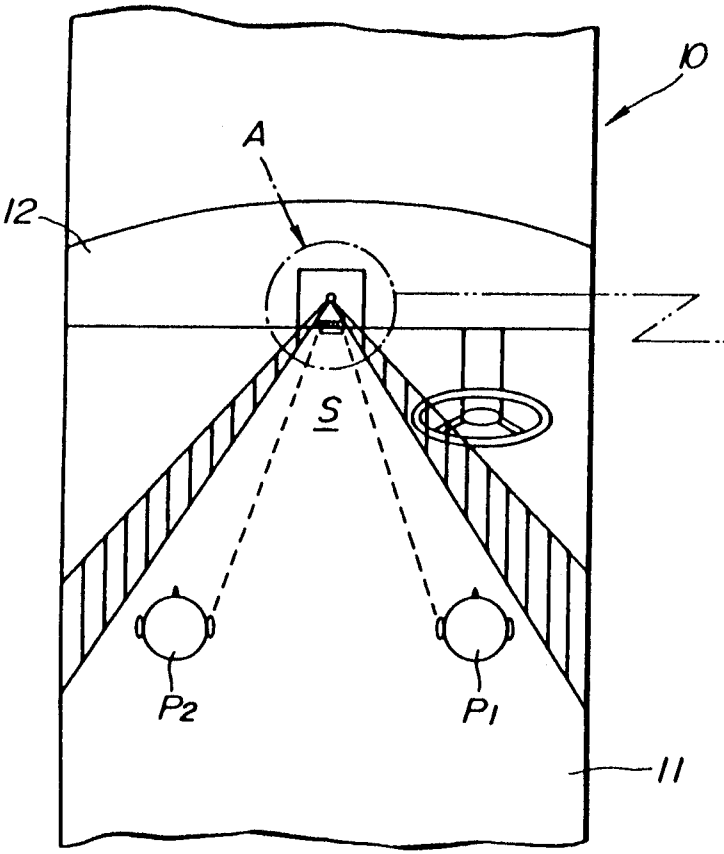

FIGS. 1 to 3 show a first preferred embodiment of the structure of the speaker according to the present invention.

The speaker apparatus 13 includes a cabinet 18 having right and left side walls 14, 15 and upper and lower walls 16, 17. The cabinet 18 has a dimension set so as to conform to that of a radio equipped in the vehicle 10 of a DIN (Deutsche Industrie Norm) standard size.

A baffle plate 19 is extended in a cabinet 18, a full-range speaker unit generally denoted by 20 being fitted to the baffle plate 19. The vibrating plate 21 of the speaker unit 20 is opposed to an upper wall 16 of the cabinet 18. A forward wall of the cabinet 18 is provided with a first opening 22 communicating with a front surface side 21*a* of the vibrating plate 21. A second opening 23 is provided at a rear wall of the cabinet 18 which communicates with a rear surface 21*b* of the vibrating plate 21. A shield plate 24 is extended over a predetermined range at the first opening 22 so as to be supported between the upper and lower walls 16, 17. The predetermined range is determined according to positions of front seat occupants $P_1$, $P_2$ who are listeners taking seats in the passenger compartment 11, as shown in FIG. 3. That is to say, a width dimension W of the shield plate 24 is determined so that ears of the occupants $P_1$ and $P_2$ are present in a projecting range S of the shield plate constituted by an angle $\theta$ with a center point of the vibrating plate 21 as a fulcrum. The first opening 22 is shielded according to the width dimension W. A tweeter 25 is mounted on an outside surface of the shield plate 24 so as to direct center portions of the front seat occupants $P_1$ and $P_2$.

In the first preferred embodiment, the sound radiated toward the rear surface 21*b* of the vibrating plate 21 in response to the operation of the speaker unit 20 is radiated by means of the second opening 23 installed in a direction different from the directions of vibrations caused by the vibrating plate 21 (denoted by D with arrow marks shown in FIG. 2), thus ensuring vibratability of the vibrating plate 21. On the other hand, the sound radiated toward the front surface side 21*a* of the vibrating plate 21 repeats reflections, vibrating air between the front surface 21*a* and upper wall 16. After the peak and dip are generated in a frequency band above 2 KHz, the sound is radiated externally from the cabinet 18 through the first opening 22 installed in a direction different from the vibrating direction of the vibrating plate 21. At this time, since the shield plate 24, having width W, encloses a space of the first opening 22 as shown in FIG. 1, a high-frequency sound range in which the sound is distorted due to the peak and/or dip is shielded by means of the shield plate 24 over the range of the projecting area S constituted by the angle $\theta$, as shown in FIGS. 3(A) and 3(B).

Hence, the distorted high-frequency sound band is radiated only toward the area denoted by oblique lines in the same drawings. Consequently, the sound which has arrived at the ears of the listeners, i.e., the occupants $P_1$, $P_2$ sitting on the front seats provides a flat frequency-characteristic sound wave.

In addition, since the tweeter 25 is mounted on the shield plate 24, the high-frequency region sound wave components are compensated by means of the tweeter 25 so that a flat reproducing sound without deterioration nor attenuation can be achieved over the full frequency band of the sound waves.

Furthermore, as shown in FIG. 8, the occupant $P_1$ sitting on the one front seat is placed at a vertex of an isosceles triangle with a line segment connecting the speaker apparatus 13 to the one side speaker 106(R) as a base. On the other hand, the occupant $P_2$ sitting on the the front seat is placed at the vertex of the isosceles triangle with the line segment connecting the speaker apparatus 13 to the other side speaker 107(R) as the base.

Consequently, a streophonic reproducing sound can be achieved in left-and-right balanced state since the occupant $P_1$ can listen the R-channel sound from the one side speaker 106(R) and the L-channel sound from the speaker apparatus 13 and the occupant $P_2$ can listen the R-channel sound from the other side speaker 107(R) and the L-channel sound from the speaker apparatus 13, respectively.

Figure 4:
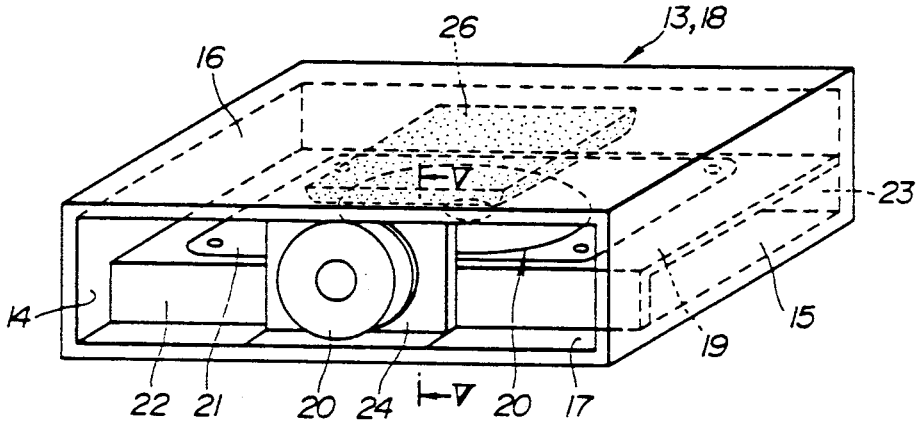
FIG. 4 is a perspective view of the structure of the speaker in a second preferred embodiment according to the present invention.
Figure 5:
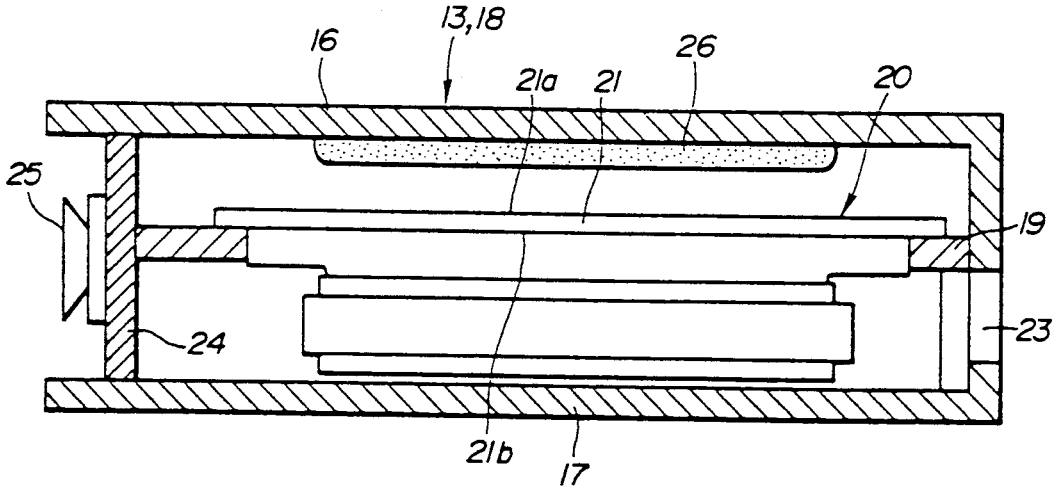
FIG. 5 is a cross sectional view of the structure of the speaker cut away along a line V—V of FIG. 4.

FIGS. 4 and 5 show a second preferred embodiment according to the present invention.

In the second preferred embodiment, a sound absorbing member 26 is adhered to a part of a rear surface of the upper wall 16 of the cabinet 18 which corresponds to the width W of the shield plate 24 (refer to FIGS. 3(A) and 3(B)).

In the second preferred embodiment, for the sound from the front side surface 21*a* of the vibrating plate 21, its reflection between the vibrating plate 21 and the part at which the sound absorbing member 26 is adhered is restricted so that the peak and dip in the high-frequency sound range are reduced.

In addition, since the shield plate 24 shields the high-frequency peak and dip when the sound is radiated through the first opening 24, the more positive ensuring of the flat frequency-characteristic of the speaker apparatus 13 can be achieved with the sound being softened by means of a buffering action of the sound absorbing member 26.

Figure 6:
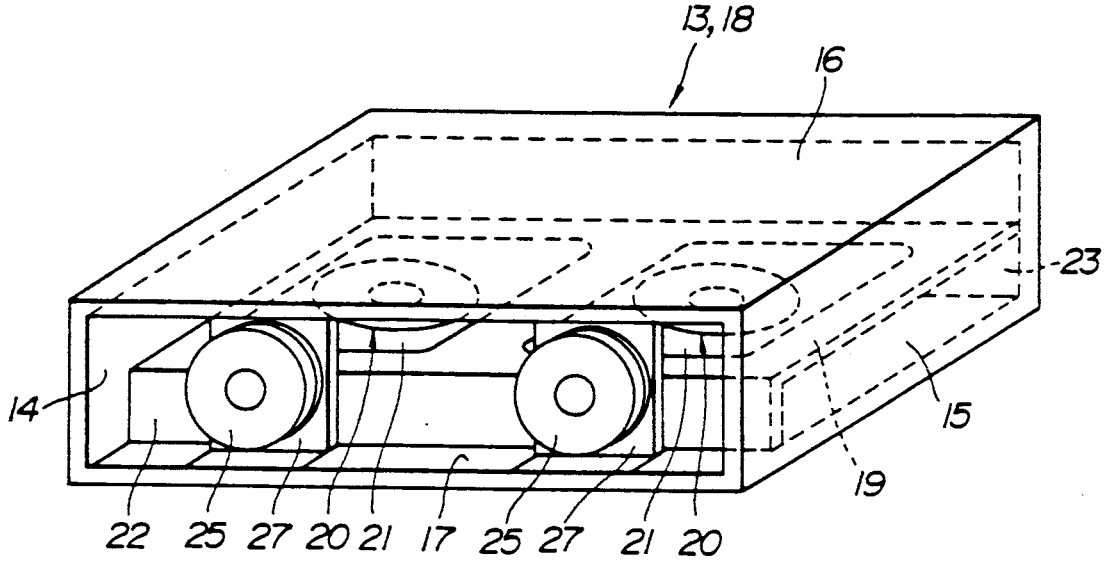
FIG. 6 is a perspective view of the structure of the speaker in a third preferred embodiment according to the present invention.

FIG. 6 shows a third preferred embodiment of the structure of the speaker according to the present invention.

As shown in FIG. 6, a pair of the speaker units 20, 20 are juxtaposed within the cabinet 18. Two shield plates 27, 27 are extended in the space of the first opening 22, corresponding to the respective speaker units 20, 20. Furthermore, two tweeters 25, 25 are fitted into the respective shield plates 27, 27 so as to direct toward the occupants $P_1$ and $P_2$. It is noted that the width dimensions of the respective shield plates 27, 27 are set so that the ears of the occupants $P_1$ and $P_2$ are present within the projecting regions $S_1$ and $S_2$ of the respective shield plates 27, 27 constituted by the angles $\theta_1$, $\theta_2$ with the center point C of the respective vibrating plates 21, 21 as focus points.

In the third preferred embodiment, when each speaker unit 20, 20 is driven with a different amplifier, the distorted sound frequency band can be shielded which appears for each speaker unit 20, 20. Therefore, it is advantageous to apply the speaker structure of the third preferred embodiment to an audio system mounted in the vehicle in which a plurality of speaker units are mutually adjoined within a narrow vehicle compartment 11.

Figure 7:
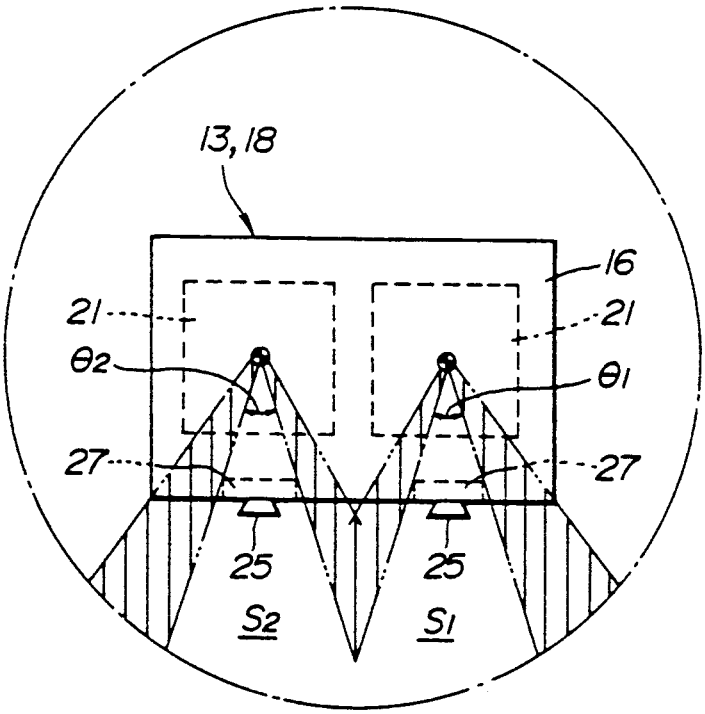
FIG. 7 is an explanatory view corresponding to part A of FIG. 3.

Although the present invention is applicable to the automotive vehicle, the present invention is also applicable to a speaker apparatus arranged in a general listening room (auditorium). In this application, the predetermined area of the opening shielded by means of the shield plate in the positional relationship to the listeners is determined in the same way as shown in FIGS. 3(A), 3(B), and 7.

Since as described herein above the cabinet accomodating the speaker unit(s) is formed with the shield plate, a sound of a front portion of the vibrating plate being radiated through the opening and the shield plate(s) being installed over the predetermined range of the opening. Hence, the sound in the particular frequency band in which the peak and/or dip is generated due to the repeating reflections against the upper wall of the opposing cabinet is shielded by means of the shield plate. Thus, the flat frequency characteristic can be achieved which is ideal for the speaker apparatus. In addition, since the tweeter(s) is fitted to the shield plate, the high-frequency range sound is compensated by means of the tweeter(s). Therefore, the reproducing sound without deterioration nor attenuation can be provided over the full frequency-range sound wave.

In the second preferred embodiment, the sound absorbing member is adhered to a part of the rear surface of the upper wall so that the reflection itself between the vibrating plate of the speaker unit(s) and upper wall is prevented. In addition a soft sound is provided due to a buffering action of the sound absorbing member.

In the third preferred embodiment, the shield plate is installed for each speaker unit in a case where the plurality of speaker units are adjoined in the cabinet. Therefore, the sound of the particular frequency band in which the peak and dip generated for each speaker unit can positively be shielded.

It will fully be appreciated by those skilled in the art that the foregoing description is made in terms of the preferred embodiments and various changes and modifications may be made without departing from the scope of the present invention which is to be defined by the appended claims.

What is claimed is:

1. A speaker apparatus, comprising:

(a) a speaker unit having a vibrating plate thereon;

(b) a cabinet of substantially rectangular cross section having a partitioning plate in a space between an upper plate portion and a bottom plate portion thereof, the speaker unit being installed on the partitioning plate so that a front surface of the vibrating plate of the speaker unit is faced against an opposing surface of the upper plate portion via the space within the cabinet, the cabinet having a first opening provided along a lower part of a first side plate portion between the upper plate portion and bottom plate portion, the first opening serving as an exit for sound wave signals generated from a rear surface of the vibrating plate of the speaker unit, and having a second opening provided along an upper part of a second side plate portion of the cabinet between the upper plate portion and bottom plate portion, the second opening serving as an exit for the sound wave signals generated from the front surface of the vibrating plate and reflected against the opposing surface of the upper plate portion of the cabinet; and (c) means, located over a predetermined part of the second opening, for shielding the sound wave signals distorted due to peaks and dips of the sound wave signals in a particular frequency band caused by repeated reflections between the front surface of the vibrating plate and the opposing surface of the upper plate portion from propagating over the predetermined part of the second opening in the direction toward an outer surface of the predetermined part and for reproducing the sound wave signals generated from the front surface of the vibrating plate of the speaker unit in the particular frequency band so as to compensate for the sound wave signals which have peaks and dips in the particular frequency band.

2. The speaker apparatus as set forth in claim 1, wherein the shielding means comprises a shield plate located so as to cover the predetermined part of the second opening.

3. The speaker apparatus as set forth in claim 2, wherein the shielding means further comprises a tweeter installed on an outer surface of the shield plate so as to face in an outer direction which is defined as a listening area of the sound wave signals generated from the front surface of the vibration plate of the speaker unit.

4. A speaker apparatus as set forth in claim 2, wherein a plurality of speaker units are incorporated in the cabinet and wherein a shield plate is provided for each speaker unit.

5. A speaker apparatus as set forth in claim 1, which further includes a sound absorbing member attached on the opposing surface of the upper plate portion of the cabinet facing toward the front surface of the speaker unit.

6. A speaker apparatus for an automotive vehicle, comprising:

a rectangularly shaped cabinet having upper, lower, front and rear faces, the cabinet being located at the center of an instrument panel of the vehicle;

a vibrating plate mounted within the cabinet, the plate oriented so that its front surface faces the upper face of the cabinet and its rear surface faces the bottom face of the cabinet;

a first opening int he rear face of the cabinet through which sound waves generated by the lower surface of the plate exit from the cabinet;

a second opening in the front face of the cabinet through which sound waves reflected between the upper face of the cabinet and the upper surface of the plate exit from the cabinet; and a shield means covering a portion of the second opening;

whereby sound waves distorted by the reflection between the upper face of the cabinet and the upper surface of the plate are shielded from transmission through the front face of the cabinet.

7. A speaker apparatus as set forth in claim 6, wherein the speaker apparatus is connected to a sound source via a main amplifier and a preamplifier.

8. A speaker apparatus as set forth in claim 6, wherein a right channel and a left channel speaker are installed such that sound fidelity is maximum at a vertex of an isosceles triangle whose bore is a line segment connecting the right and left speakers.

9. A speaker apparatus as set forth in claim 8, wherein the shielding means is located in a region such that sound fidelity is maximum within a projecting angular region of the shielding means constituted by an angle having the center of the vibrating plate as with origin of the angle.

10. A speaker apparatus as set forth in claim 9, wherein the shield means comprises a shield plate having a predetermined width so as to produce the projecting region.

11. A speaker apparatus as set forth in claim 10, wherein surface of the shield plate is provided with a tweeter.

12. A speaker apparatus as set forth in claim 10, wherein the cabinet contains a plurality of speakers and a plurality of the shield plates are located in each part of the opening so as to correspond to the respective speakers.

13. A structure as set forth in claim 11, wherein the tweeter is faced toward a center of the vehicle.

14. A speaker apparatus as set forth in claim 6, wherein the cabinet includes an upper casing, a baffle plate having a second opening into which the vibrating plate is fitted so as to face toward an inner wall of the upper casing, and a lower casing having a third opening exposed in a direction opposite to the first direction and enclosing the speaker unit, the first opening being defined by the upper and lower casings.

15. A speaker apparatus as set forth in claim 6, wherein the size of the cabinet conforms to the interior dimensions of the vehicle.

16. A speaker apparatus, comprising:

a) a sound producing object:

b) a container housing the sound producing object and having a first opening in a direction substantially perpendicular to a direction toward which the sound is propagated from a first surface of the sound producing object which generates a distorted sound wave signal in a particular frequency band and a second opening in a direction substantially perpendicular to another direction toward which the sound is propagated from a second surface of the sound producing object; and c) means provided at the first opening so as to provide a substantially flat frequency characteristic for the sound wave signals generated by the sound producing object, said means having a shield plate provided over a predetermined width of the first opening for preventing the propagation of the sound wave signal distorted in the particular frequency band over the predetermined width of the first opening and a tweeter provided over the shield plate for reproducing the sound wave signal in the particular frequency band so as to compensate for the sound wave signal generated from the sound producing object in the particular frequency band.

17. A speaker apparatus as set forth in claim 16, wherein the sound producing object is a speaker unit, the container having a rectangular box shape and installed in the center of an instrument panel of a vehicle so that sound wave signals having peaks and dips in a particular frequency band are shielded from being received by a listener.

* * * * *